United States Patent [19]

Ausiello et al.

[11] Patent Number: 4,872,438

[45] Date of Patent: Oct. 10, 1989

[54] FUEL INJECTION SYSTEM WITH CONTROLLED INJECTORS FOR DIESEL ENGINES

[75] Inventors: Francesco P. Ausiello, Torino; Mario Ricco, Bari; Sisto Luigi De Matthaeis,

Modugno, all of Italy

[73] Assignee: Weber S.r.l., Italy

[21] Appl. No.: 236,539

[22] Filed: Aug. 25, 1988

[30] Foreign Application Priority Data

Aug. 25, 1987 [IT] Italy ..... 67735 A/87

[51] Int. Cl.[4] ..... F02M 31/20; F02M 31/16

[52] U.S. Cl. ..... 123/514; 123/510; 123/541

[58] Field of Search ..... 123/510, 511, 512, 513, 123/514, 541

[56] References Cited

U.S. PATENT DOCUMENTS

| | | | |
|---|---|---|---|
| 2,599,699 | 6/1952 | Dilworth | 123/514 |
| 3,973,536 | 8/1976 | Zelders | 123/541 |
| 4,187,813 | 2/1980 | Stumpp | 123/541 |
| 4,377,149 | 3/1983 | Naylor | 123/510 |
| 4,385,615 | 5/1983 | Keane | 123/514 |
| 4,411,239 | 10/1983 | Kelch | 123/514 |
| 4,432,329 | 2/1984 | Redele | 123/514 |

FOREIGN PATENT DOCUMENTS

| | | |
|---|---|---|
| 2386692 | 3/1978 | France . |
| 2490733 | 3/1982 | France . |
| 58-106135 | 6/1983 | Japan . |
| 58-158363 | 9/1983 | Japan . |

*Primary Examiner*—Willis R. Wolfe
*Assistant Examiner*—M. Macy

[57] ABSTRACT

A fuel injection system with controlled injectors for diesel engines includes a system for regulating the temperature of the fuel, including thermostatically-controlled preheating means associated with the fuel supply circuit and electronically-controlled cooling means associated with the fuel recycling circuit.

4 Claims, 1 Drawing Sheet

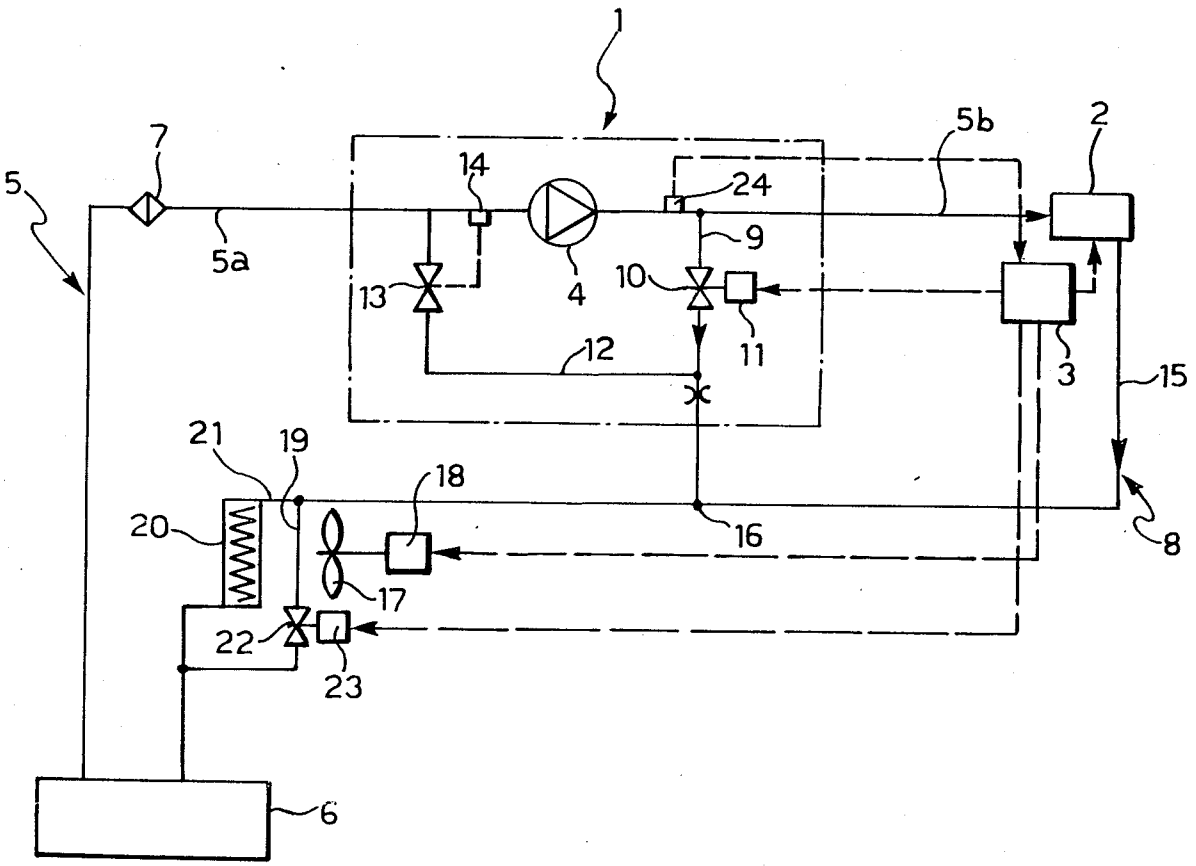
1
2
3
4
5
5a
5b
6
7
8
9
10
11
12
13
14
15
16
17
18
19
20
21
22
23
24

FUEL INJECTION SYSTEM WITH CONTROLLED INJECTORS FOR DIESEL ENGINES

The present invention relates in general to fuel injection systems with controlled injectors for diesel engines.

More particularly, the invention concerns an injection system of the type comprising a fuel tank, a supply circuit including a pump for conveying the fuel under pressure from the tank to the controlled injectors, and a circuit for recycling the fuel to the tank, including a return line from the pump in which a solenoid pressure-regulating solenoid valve is inserted, and a return line from the injectors which is joined by the return line from the pump.

The object of the present invention is to provide an injection system of the type specified above, arranged to control and regulate the temperature of the fuel supplied to the injectors in order to ensure a more regular and correct operation.

According to the invention this object is achieved by means of a fuel injection system of the type defined at the beginning, characterized in that it includes a system for regulating the temperature of the fuel, including:

preheating means including a branch line which connects the return line from the pump downstream of the solenoid pressure-regulating valve with the supply circuit upstream of the pump, and thermostatically-controlled cut-off valve arranged to allow the fuel to flow through the branch line when the temperature of the fuel upstream of the pump is below a predetermined threshold value and to stop this flow when the temperature exceeds the threshold value, and cooling means including means for sensing the temperature of the fuel in the supply circuit downstream of the pump and upstream of the return line from the pump, electrically-controlled cooling means associated with the return line from the injectors downstream of the return line from the pump, and an electronic unit for controlling the cooling means in response to signals provided by the temperature sensor means.

By virtue of this solution, it is possible to keep the temperature of the fuel conveyed to the injectors substantially constant both in low-temperature environments and/or operative conditions and in high temperature conditions. In the first case, the cold fuel from the tank is mixed upstream of the intake side of the pump with that heated as a result of lamination by the solenoid pressure-regulating valve, until the desired temperature is reached. In the second case, however, the fuel is cooled before its return to the tank. This cooling may be achieved with the use of an auxiliary heat exchanger and possibly an electric fan associated therewith, or simply by means of an electric fan associated directly with the return tubes for the fuel or with the tank itself. When the pump has means for reducing the fuel delivery, the cooling may also be achieved by intervention on the reduction means so as to reduce the lamination of the fuel by the solenoid regulating valve and the consequent increase in the temperature resulting from this lamination.

The invention will now be described in detail with reference to the appended drawing, provided purely by way of non-limiting example, showing a fuel injection system according to the invention in schematic form.

With reference to the drawing, a pumping unit of a fuel injection system for diesel engines is schematically and generally indicated 1 and is provided with a unit with controlled injectors, schematically indicated 2. These injectors are normally of the electrically-operated type and are controlled in known manner by an electronic unit 3.

The pumping unit 1 includes a pump 4, normally of the reciprocating in-line or radial type, conveniently provided with devices, not illustrated, for reducing the fuel flow, associated with the intake and/or the delivery.

The pump 4 is connected in a circuit 5 for supplying the fuel from a tank 6 to the injectors 2, including an inlet line **5*a* connected to the intake side of the pump 4 and in which a filter 7 is inserted, and a delivery line 5*b* connecting the delivery side of the pump 4 to the injectors 2**.

A circuit for recycling the fuel from the injectors 2 to the tank 6 is generally indicated 8. This recycling circuit 8 includes a return line 9 from the pump 4, which is connected to the delivery line **5*b* and in which is inserted a pressure-regulating valve 10 with an electrical control 11 piloted by the electronic control unit 3. The solenoid valve 10, 11** may for example be of the type forming the subject of Italian Utility Model Application No. 54052-B/86 in the name of the same Applicants.

The return line 9 from the pump 4 is connected to the inlet line **5*a* by means of a branch line 12 in which is connected a cut-off valve 13 with a thermostatic control 14 sensitive to the temperature of the fuel in the line 5*a* upstream of the intake side of the pump 4. The thermostatic control 14 controls the cut-off valve 13 so as to enable the fuel to flow through the branch line 12 when the temperature of the fuel upstream of the pump 4 is below a predetermined threshold value and to stop this flow when the temperature of the fuel upstream of the pump 4** exceeds this threshold value.

The recycling circuit 8 also includes a return line 15 from the injectors 2 to the tank 6, which is joined at 16 by the return line 9 from the pump 4 downstream of the branch line 12.

Downstream of the junction 16, the return line 15 from the injectors 2 has associated fuel cooling means. In the embodiment illustrated, these means comprise a fan 17 with an electrical control 18 piloted by the electronic control unit 3 and arranged to generate a cooling air-flow directly towards a portion 19 of the return line 15. This portion 19 may conveniently be coiled.

In addition or alternatively, the cooling means may include a heat exchanger 20 inserted in a branch passage 21 of the line 15. In this case, the passage of the fuel through the line 19 or through the line 21 is controlled by means of a valve 22 with an electrical control 23 controlled by the electronic unit 3. Moreover, in this case, the electric fan 17, 18 may be operatively associated with the heat exchanger 20.

Alternatively or in addition, the cooling means for the fuel may be constituted by the delivery reducing devices themselves associated with the pump 4 and piloted electrically by the electronic control unit 3.

In each case, the piloting by the unit 3 is effected in response to electrical temperature signals from a sensor 24 arranged to detect the temperature of the fuel in the delivery line **5*a* upstream of the return line 9 from the pump 4, and to supply corresponding electrical signals to the unit 3**.

In operation, the system according to the invention is able to direct the fuel to the injectors 2 at a regulated temperature. In the case of low-temperature climatic and/or operative conditions, the regulation is effected by the thermostatic valve 13, 14 by means of which the fuel is laminated and thus heated and is mixed upstream of the intake side of the pump 4 with that coming from the inlet line 5*a* of the supply circuit 5. The preheating action is stopped when the valve 13 is closed by the thermostatic actuator 14 as the predetermined threshold level is reached.

In high temperature conditions, however, the fuel is cooled in the recycling circuit 8 by the activation of the electric fan 17, 18 and/or the connection of the heat exchanger 20 operated by means of the control of the solenoid valve 22, 23, and/or through the operation of the delivery reducing devices associated with the pump 4. As stated above, the cooling action is piloted by the electronic unit 3 in dependence on the temperature of the fuel downstream of the delivery from the pump 4 detected by the sensor 24.

We claim:

1. A fuel injection system with controlled injectors for diesel engines, comprising a fuel tank, a supply circuit including a pump for conveying the fuel under pressure from the tank to the controlled injectors, and a circuit for recycling the fuel to the tank, including a return line from the pump in which a solenoid pressure regulating valve is inserted, and a return line from the injectors which is joined by the return line from the pump, including a system for regulating the temperature of the fuel, including:

preheating means including a branch line (12) which connects the return line (9) from the pump (4) downstream of the solenoid pressure-regulating valve (10, ii) with the supply circuit (5*a*) upstream of the pump and a cut-off valve (13) having a thermostatic control (14) and arranged to allow the fuel to flow through the branch line (12) when the temperature of the fuel upstream of the pump (4) is below a predetermined threshold value and to stop this flow when the temperature exceeds the threshold value, and cooling means including means (24) for sensing the temperature of the fuel in the supply circuit (5*b*) downstream of the pump (4) and upstream of the return line (9) from the pump (4), electrically-controlled cooling means (17, 18; 20, 21, 22, 23) associated with the return line (15) from the injectors (2) downstream of the return line (9) of the pump (4), and an electronic unit (S) for controlling the cooling means in response to signals provided by the temperature sensor means (24).

2. A system according to claim 1, wherein the cooling means include an electric fan (17, 18) associated with the return line (15) from the injectors (2).

3. A system according to claim 1 or claim 2, wherein the cooling means include a heat exchanger (20) and solenoid valve means (22, 23) for opening or closing the passage through the heat exchanger (20) for the fuel coming from the return line (15) from the injectors (2).

4. A system according to, claim 1 or claim 2 wherein the pump has means for reducing the fuel delivery, and the cooling means include electrical means for controlling the delivery reducing means.

* * * * *